US005816726A

United States Patent [19]

DeBourg et al.

[11] Patent Number: 5,816,726

[45] Date of Patent: Oct. 6, 1998

[54] HAIR REMOVAL APPLICATOR AND APPLICATION SYSTEM

[75] Inventors: Jean-Pierre DeBourg, Lyons; Daniel Bontoux, Saint-Genis-Laval, both of France

[73] Assignee: SEB S.A., Ecully, France

[21] Appl. No.: 719,616

[22] Filed: Sep. 25, 1996

[30] Foreign Application Priority Data

Oct. 3, 1995 [FR] France ..... 95 11618

[51] Int. Cl.[6] ..... A45D 26/00

[52] U.S. Cl. ..... 401/1; 401/2; 401/208

[58] Field of Search ..... 401/1, 2, 208; 219/618

[56] References Cited

U.S. PATENT DOCUMENTS

| | | | |
|---|---|---|---|
| 428,379 | 5/1890 | Colby | 219/618 X |
| 457,561 | 8/1891 | Kennedy | 219/618 X |
| 1,821,530 | 9/1931 | Spire | 219/618 |
| 3,430,816 | 3/1969 | Nadherny et al. | 401/1 X |
| 3,845,268 | 10/1974 | Sindt | 219/10.77 |
| 4,499,355 | 2/1985 | Walter . | |
| 4,958,951 | 9/1990 | Mann . | |
| 5,395,175 | 3/1995 | Bontoux et al. | 401/2 X |

FOREIGN PATENT DOCUMENTS

| | | |
|---|---|---|
| 0 499 318 | 8/1992 | European Pat. Off. . |
| 0 592 340 | 4/1994 | European Pat. Off. . |
| 0 629 366 | 12/1994 | European Pat. Off. . |
| 1553082 | 12/1968 | France . |
| WO 89/10324 | 11/1989 | WIPO . |

*Primary Examiner*—Steven A. Bratlie
*Attorney, Agent, or Firm*—Young & Thompson

[57] ABSTRACT

A hair removal wax application system is composed of an applicator (1) comprising a tank (8) designed for accommodating a volume of hair removal wax (20). The tank (8) has an opening (14) at least partially closed by a distribution ring (7, 9) for the wax (20). There is a seat (2) on which the applicator (1) can be placed. The applicator (1) can be disconnected from the seat (2) in order to be used as a self-contained apparatus when applying molten wax (20) on the zone to be depilated. A heater melts the hair removal wax (20) in the applicator's (1) tank (8) and is supplied with electric current from the seat (2). The heater is an inductor (4) rigidly connected to the seat (2) and an armature (6, 18, 19) connected rigidly to the distribution ring (7, 9). The distribution ring (7, 9) is rotatable in the tank (8) and has a diameter between 60 and 95% of the greatest internal dimension of the tank.

10 Claims, 2 Drawing Sheets

HAIR REMOVAL APPLICATOR AND APPLICATION SYSTEM

This invention relates to the general technical field of the application devices of thermofusible produces, such as hair removal wax, in which the produce is stored in solid form and must be exposed to a calorific supply in order to change state and to take on a condition which is at least pasty to enable the application process.

The purpose of the invention is more specifically to provide an application assembly as well as a hair removal wax applicator.

Whatever the application type of hair removal wax considered, the hair removal technique by application of a wax consists in melting a certain quantity of wax, then in applying, in molten condition, a coat of wax onto the zone to be depilated. After hardening, i.e. cooling down, the film of cold wax can be removed and the hairs are then extracted from the skin by sticking to the wax.

The implementation of these techniques generally calls for the use of relatively cumbersome devices, leading to a long, tedious and often soiling hair removal operation.

In order to use this technique, application devices are already known, mainly composed of a heated tank enabling to liquefy the hair removal wax. These devices are completed by an applying element, of the spatula or roller type, independent from the tank, that the user inserts into the mass of molten wax in order to sample a certain quantity that she can then spread over the zone to be deplicated.

These devices exhibit the advantage of being simple and of enabling to use any kind of wax, their handling remains however extremely tricky. The application temperature of the wax is difficult to control as well as the application thickness of the coat of wax on the zone to be depilated.

In order to improve the conventional devices mentioned previously, application devices containing a portable distribution element have already been suggested, connected to the tank by a flexible hose. A pumping system enables driving the wax from the tank to the hose, then towards the distribution body.

These devices advantageously exhibit a very large autonomy. The pumping system enables to lift the wax and hence its application to the zone to be depilated whatever the orientation of this zone in space. However, such devices remain relatively cumbersome and call for a relatively long operation.

In order to improve the conventional devices still further, self-contained devices have been developed, especially the one described in the application for a European patent EP-0.629.366 relating to an applicator of thermofusible products, particularly hair removal wax. This device comprises a casing, associated with pick-up means, a tank of hair removal product made of a good heat conducting material, preferably aluminium. This tank is in thermal relation with external heating means. At least one application roller has been arranged at the vicinity of an outlet orifice of the tank, in order to enable the application of the hair removal wax on the desired zone.

Another device of comparable type has been developed in the application for European patent EP-0.592.340 relating to an applicator of thermofusible products, particularly hair removal wax, also comprising a casing, associated with pick-up means, a tank containing the product to be applied and at least one application means of the product placed in the vicinity of the outlet orifice of the tank. In the device described in this document, at least one section of the tank is made of electric current conducting plastic material, thus constituting heating means.

Both previous devices, compact in shape, control the application temperature of the wax, make the use and cleaning of the devices easier and limit the risk of soiling the environment.

However, previous devices, although meeting many requirements of the users can still be improved.

During the hair removal operation, the molten wax placed in the tank has to be brought to the point of contact with the skin. With previous devices in which the molten wax flows from the tank to the application means according to a gravitational principle, the applicator must operate upside down, which makes certain zones inaccessible.

Another difficulty lies with the heating systems used and designed for melting the wax, which makes the miniaturization of these devices particularly tricky, if not impossible.

The subject of this invention thus aims at remedying the shortcomings of the conventional devices and especially to provide an application system of hair removal wax whose design and embodiment are peculiarly simplified, while enabling good control of the application temperature as well as ease of handling.

Another purpose of the invention is to have an application system comprising heating means simplifying electric connections, but still reliable, as well as application means limiting the risk of leakage.

It is also a purpose of the invention to enable the user easier handling of the device over her body and even in areas difficult to access, thanks to a handy apparatus with a self-contained applicator whose simplified design enables easy miniaturization. A purpose of the invention is also to provide a device with small space requirements and which is easy to handle.

In order to achieve these objects the invention relates to a hair removal wax application system composed of the following:

- an applicator comprising a tank designed for accommodating a volume of hair removal wax, wherein the said tank has an opening at least partially closed by distribution means of the said wax,
- a seat on which the applicator can be placed, wherein the applicator can be disconnected from the seat in order to be used as a self-contained apparatus when applying molten wax on the zone to be depilated
- heating means, designed for melting the hair removal wax in the applicator's tank and supplied with electric current from the seat.

According to the invention, the heating means are induction means, comprising an inductor rigidly connected to the seat and an armature connected rigidly to the applicator.

An induction heating device, applied to the melting of the hair removal wax, enables to have heating means of simplified design, and this especially as regards the applicator. This new conception enables important simplification of the electric connections.

With various particular embodiments, the invention exhibits the following characteristics, taken individually or with all their technically possible combinations:

- the armature connected rigidly to the applicator is connected rigidly to the tank,
- the armature connected rigidly to the applicator is integrated using the distribution means of the hair removal wax,
- the distribution means plunge inside the tank and are in contact with the hair removal wax contained in the tank, whatever the filling level of the wax and the orientation of the tank's opening, the tank is more or less cylindrical in shape, the distribution means comprise a cylindrical distribution ring placed in the tank, mobile in rotation, the axis of the cylindrical ring and the axis of the tank cylindrical in shape are parallel, whereby the outer diameter of the ring ranges between 60 and 95% of the inner diameter of the tank, for example more or less equal to 85%, the distribution ring comprises a first rigid electrically conducting ring, advantageously magnetizable constituting at least a section of the armature connected rigidly to the applicator, whereas the said first ring is surrounded on its outer surface by a second ring made of an insulating material, the distribution means are maintained in position inside the tank by studs connected rigidly to the tank.

The invention also relates to the hair removal wax applicator intended to be used in the application system complying with the invention.

Various other characteristics and advantages of the invention will become clearer in the light of the following description, given for exemplification purposes and without any limiting nature, in connection with the appended drawings, on which:

Inasmuch as possible, the same reference signs have been used in order to represent identical elements found in the various embodiments of the invention.

Figure 1:
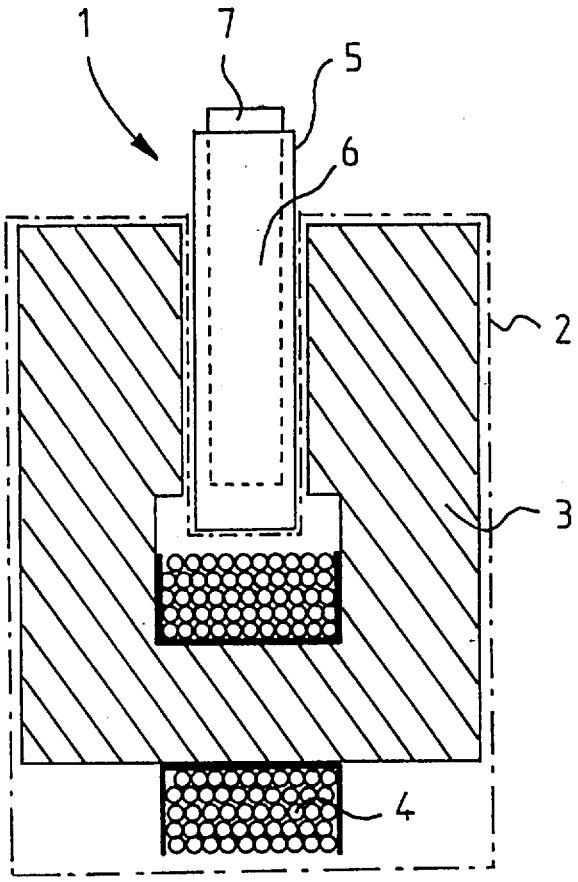
FIG. 1 represents an embodiment of an application system according to the invention, in which an applicator, viewed sideways, has been placed on its seat, serving as a supply block, seen as a cross-section.

The hair removal wax application system represented more especially on FIG. 1, comprises an applicator 1 shown in position on its seat 2. This seat 2 serves as a stay for the applicator 1 and also enables to power supply the heating means.

The seat 2 comprises mainly the induction elements of the heating means. This inductor comprises a coil 4, through which circulate appropriate alternate currents, and that enables to create a magnetic field. This magnetic field is transmitted to a ferrite member 3, or magnetic field conducting matter, exhibiting two parallel surfaces opposite to one another on each side of the housing designed for accommodating the applicator 1 in order to constitute an air gap at the level of this housing.

The applicator comprises a casing 5 in which have been arranged an electricity conducting armature 6 and distribution means 7 of the hair removal wax contained in the applicator 1.

During operation and when the applicator 1 is placed on its seat 2, the appropriate alternate current circulating through the coil 4 creates a magnetic field, channelled by the ferrite member 3 outside the applicator 1. The magnetic field goes through the armature 6 and there generates induction currents. The armature 6, connected rigidly to the applicator 1 becomes thus heated by an electromagnetic induction phenomenon and transmits a heat supply to the hair removal wax contained inside the applicator 1, which under the effect of the heat changes its physical condition in order to liquefy sufficiently to be spread in the form of a coating.

Figure 2:
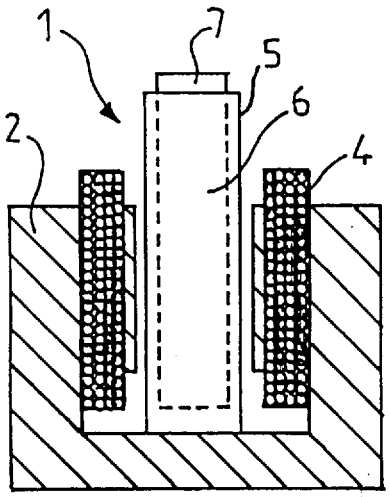
FIG. 2 represents another embodiment of the seat in a view similar to that of FIG. 1.

According to another embodiment, represented more specifically on FIG. 2, the inductor integrated to the seat 2 exhibits a peculiarly simplified shape.

The inductor comprises essentially a coil 4 made of two sections arranged on either side of the housing designed for accommodating the applicator 1, in order to produce induction effects there. The armature 6 connected rigidly to the applicator 1 can thus be put in relation directly with the magnetic field created by the coil 4 and transmit a heat supply to the hair removal wax, contained in the applicator 1, by an electromagnetic induction phenomenon.

Therefore, the seat enables also to power the heating means. Since the electric transmission is performed according to an electromagnetic induction phenomenon, the connections between the applicator 1 and the seat are particularly simplified and allow, among other things, to miniaturize the applicator 1.

The use of the hair removal wax application system may thus be performed as follows: the user places the applicator 1 on the seat 2 designed for that purpose, then switches the electric supply on the coil 4. The induced currents transmitted into the armature 6 heat up the said armature, the heat spreads throughout the wax and melts it. Once the wax has molten, the user removes the applicator 1 from its seat 2 and may stop the electric supply of the inductor.

It is also possible to arrange means for controlling or automating certain phases, and especially to have means for delaying the electric supply, thus enabling automatic stopping of the heating elements and limiting the risks of overheating. Various other means can also be foreseen in order to supply the appropriate alternate current.

Different embodiments of the applicator 1 are represented on FIGS. 3, 4, 5, 6, 7 and 8.

Figure 3:
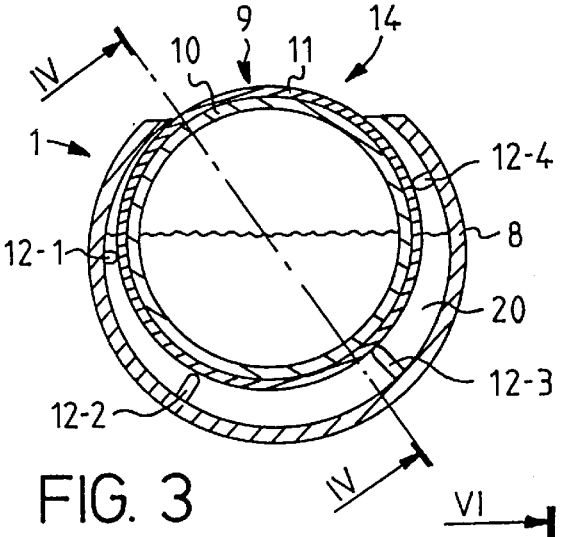
FIG. 3 represents a front cross-section of an embodiment of the hair removal wax applicator, taken on the III—III plane of FIG. 4.

In the embodiment represented on FIG. 3, the applicator 1 comprises a tank 8 designed for accommodating a given volume of hair removal wax 20. This tank 8 also allows handling the applicator 1 and thus takes on the part of a casing.

The tank 8 is fitted with an opening 14 at least partially closed by distribution means 9 of the wax 20.

The tank 8 is more or less cylindrical in shape and more precisely a circular cylindrical shape, comprising a flat bottom and a flat top or lid linked together by a side wall, truncated at the level of the opening.

The distribution means 9 comprise a cylindrical distribution ring, mobile in rotation, placed in the tank 8. Advantageously, the rotation axis of the cylindrical distribution ring and the axis of the cylindrical tank are parallel.

The outer diameter of the distribution ring ranges advantageously between 60 and 95% of the inner diameter of the cylindrical tank 8 and for instance more or less equal to 85%. This embodiment thus enables to have distribution means 9 plunging inside the tank 8 in order to come in contact with the hair removal wax 20, and this whatever the filling level of the hair removal wax and whatever the orientation of the opening 14 of the tank 8. When the distribution ring 9 is subject to rotation, it drives on its surface the wax 20 stored inside the tank 8. It covers the given zone with a thickness of wax corresponding to the gap adjusted by the opening 14. The wax can then be deposited on the surface to be depilated. This wax transfer operates whatever the position of the casing. The application of the hair removal wax thus does not depend on the gravitational flow of the wax 20 stored in the tank 8.

Advantageously, the distribution ring 9 comprises a first rigid ring 10 made of an electrically conductive matter, constituting at least one section of the armature connected rigidly to the applicator.

The armature 6 itself can also contain a magnetisable circuit channelling the flow of magnetic field inside the applicator 1, which advantageously reduces the reluctance phenomenon, or resistance to the passage of the magnetic field, of the armature 6.

Thus, according to a more sophisticated version than the previous one, the first ring 10 is itself made up of an inner magnetizable ring, for example of ferrite, and of a surrounding outer ring of a highly electrically conductive matter, for example copper.

According to another version, the first ring 10 combines magnetic field as well as electrical conduction properties at the same time. Typically, it can be made of steel.

The first ring 10 serves therefore also as an induction wrap and can act as a heating element, arranged inside the tank 8, just like an immersion heater arranged inside the wax 20 and in direct contact with the said wax.

Advantageously, the first ring 10, constituted at least partially of an electrically conductive matter, is covered on its outer surface by a second ring 11, concentric with the first, constituted of an insulating matter of small thickness. This second ring 11 serves as an envelope to the distribution ring 9 and provides better distribution of the heat inside the hair removal wax 20. On the other hand, during the application of the molten wax on the zone to be depilated this second ring 11 avoids too high a sensation of heat owing to its low thermal conductivity.

The distribution ring 9 is maintained in position inside the tank 8 via studs 12 connected rigidly to the tank 8. With the embodiment represented on FIGS. 3 and 4, the studs 12-1, 12-2, 12-3, 12-4 contact the outer surface of the distribution ring 9. These outer studs 12 can be arranged by pairs, placed opposite one another as represented for the studs 12-3 and **12-3*b* on FIG. 4**.

The particular shape of the distribution means 9 enables it to extend through the major part of the internal volume of the tank 8, whereas the thickness of the distribution ring is comparable to that of the inside of the tank 8. However, the open shape of the distribution ring allows only marginal limitation of the volume of hair removal wax 20 that can be stored inside the tank 8. The side play between the distribution ring and the internal walls of the tank 8 enables the wax 20 to circulate inside the tank, and therefore essentially to coat the outer surface of the distribution ring when rotating.

Figure 5:
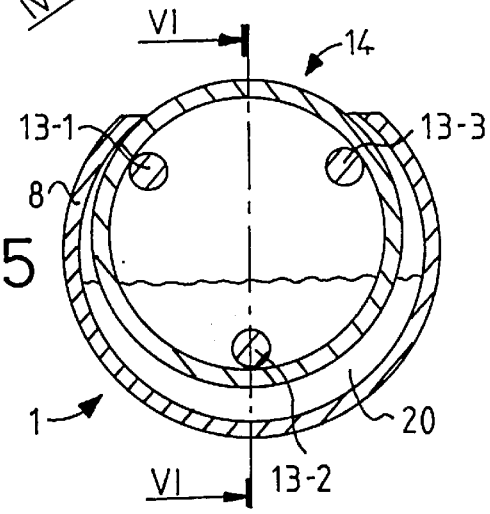
FIG. 5 is another embodiment of the hair removal wax applicator, along the V—V plane of FIG. 6, similar FIG. 3.
Figure 6:
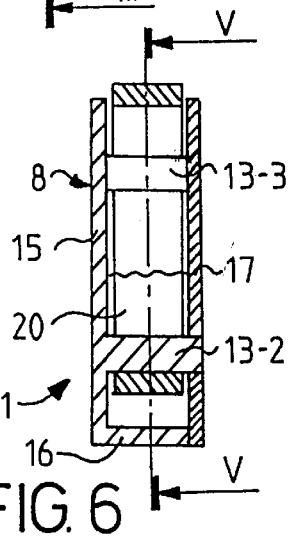
FIG. 6 is a sideways cross-section along the VI—VI plane, relating to the applicator represented on FIG. 5.

Another embodiment of the applicator 1 is represented more particularly on FIGS. 5 and 6.

The essential characteristics of this variation consist in the positioning mode of the distribution roller inside the tank 8. The distribution ring is maintained in position inside the tank 8 by studs 13 connected rigidly to the tank 8. However in this case, the studs 13-1, 13-2, 13-3 contact the internal surface of the distribution ring.

This particular arrangement enables the distribution ring to drive the hair removal wax 20 over its whole external surface without being somehow raked by the action of the studs contacting the said external surface. The hair removal wax can thus be distributed evenly over the whole external surface of the distribution ring, whereas this distribution makes use of the gap situated for that purpose between the distribution ring and the opening 14 arranged in the wall 16 of the tank 8.

The studs 13 also enable to link both plane surfaces 15, 17 of the tank 8 and thus to increase its stiffness.

In the embodiment represented on FIG. 6, the plane lid 17 of the tank 8 can be assembled in a detachable way, so that the tank 8 can be easily filled up for the next operation. Various other configurations can be contemplated in order to enable topping up the tank 8, especially by arranging side openings that can be closed.

It can also be foreseen to provide a single use applicator 1, i.e. with a single filling. In this case, the applicator 1 is pre-filled before being marketed and when it is empty, the user replaces it with a new applicator. In such a case, advantageously at least one of the walls of the tank 8 is partially made of clear matter enabling to control the filling level of the tank 8.

Figure 8:
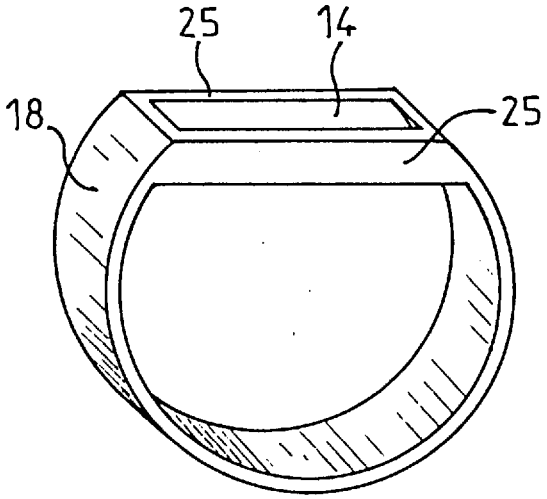
FIG. 8 shows the ring of the applicator 1 represented on FIG. 7 in perspective.
Figure 7:
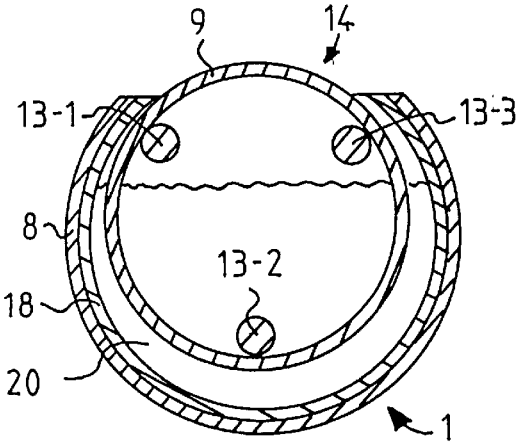
FIG. 7 represents in a view similar to that of FIG. 3 and of FIG. 5, another embodiment of the applicator.

On FIGS. 7 and 8 are represented various embodiments of the applicator 1.

In the embodiment represented more particularly on FIG. 7, the armature connected rigidly to the applicator 1 is connected rigidly to the tank 8. A truncated ring 18 arranged along the internal surface of the side walls of the tank 8, constitutes the armature enabling to heat the wax 20 contained inside the tank 8. This ring 18 can cover the whole internal surface of the tank 8 or cover it only partially, for instance cover solely the circular side wall, both plane surfaces or only one of these surfaces.

In case the ring 18 only covers the circular side wall, the continuous path of the induced current is ensured by two electricity conducting legs 25, arranged on either side of the opening 14 parallel to the plane surfaces of the internal surface of the tank 8.

Figure 9:
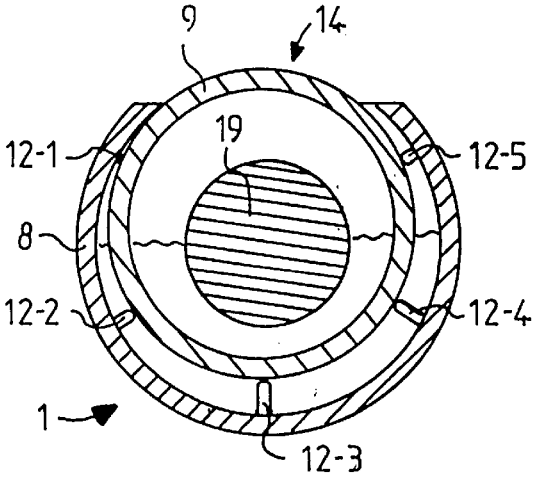
FIG. 9 represents a view comparable to FIG. 7 of another embodiment of the hair removal wax applicator.

In the embodiment represented on FIG. 9, a part 19 constituting the armature connected rigidly to the applicator 1, is inserted inside the tank 8. Advantageously, this part 19 is placed more or less in the center of the tank 8 or slightly in its lower section. This part made of ferromagnetic matter is of a smaller size than the distribution ring 9. This enables to minimize the dimensions of the electromagnetic circuit. However, this arrangement also reduces the useful volume of the tank 8 and limits its capacity.

The invention is not limited to the details of the embodiments described previously, but also covers especially variations making use of equivalent means. Different variations of the application system are possible, particularly as regards the shape of the seat 2, its dimension and the number of windings constituting the coil 4. Some embodiments of additional means allow also to deliver the appropriate alternating current enabling to create the electromagnetic filed.

The distribution ring 9 is maintained inside the tank by studs 12, 13 contacting the internal surface or the external surface of the ring 9. The number of these studs can also vary from one embodiment to the other.

Figure 4:
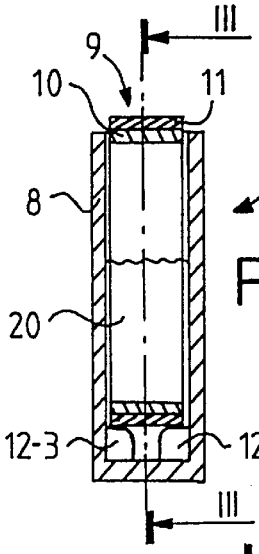
FIG. 4 is a sideways cross-section, of the applicator represented on FIG. 3, along the IV—IV plane of FIG. 3.

In the embodiment represented on FIGS. 3 and 4, the distribution ring 9 is constituted of a rigid ring 10 covered by an insulating ring 11. The material of this insulating ring enables to limit the heat sensation during the application of the hair removal wax. The material of this ring can also be selected in order to facilitate the application of the hair removal wax, whereby the latter sticks sufficiently to that material in order to be driven, but sticking more strongly the skin so that it can be applied easily.

We claim:

1. In a hair removal wax application system composed of:

an applicator (1) comprising a tank (8) designed for accommodating a volume of hair removal wax (20), wherein the said tank (8) has an opening (14) at least partially closed by distribution means (7, 9) of the said wax (20), a seat (2) on which the applicator (1) can be placed, wherein the applicator (1) can be disconnected from the seat (2) in order to be used as a self-contained apparatus when applying molten wax (20) on the zone to be depilated, and heating means, designed for melting the hair removal wax (20) in the applicator's (1) tank (8) and supplied with electric current from the seat (2);

the improvement wherein the heating means are induction means, comprising an inductor (4) rigidly connected to the seat (2) and an armature (6, 18, 19) connected rigidly to the distribution means (7, 9).

2. A hair removal wax application system according to claim 1, wherein said distribution means (7, 9) is a ring rotatable in the tank (8).

3. A hair removal wax application system according to claim 2, wherein said ring comprises a first rigid electrically conductive ring (10) covered on its outer surface by a second ring (11) made of an insulating material.

4. A hair removal wax application system according to claim 3, wherein said conductive ring (10) is magnetizable.

5. A hair removal wax application system according to claim 2, and studs (12, 13) connected rigidly to the tank (8) to maintain said ring rotatably mounted in said tank (8) about an axis fixed relative to the tank.

6. A hair removal wax application system according to claim 5, wherein said tank is cylindrical and has a center of curvature parallel to and spaced from the center of curvature of said ring.

7. In a hair removal wax application system composed of:

an applicator (1) comprising a tank (8) designed for accommodating a volume of hair removal wax (20), wherein the said tank (8) has an opening (14) at least partially closed by distribution means (7, 9) of the said wax (20), a seat (2) on which the applicator (1) can be placed, wherein the applicator (1) can be disconnected from the seat (2) in order to be used as a self-contained apparatus when applying molten wax (20) on the zone to be depilated, and heating means, designed for melting the hair removal wax (20) in the applicator's (1) tank (8) and supplied with electric current from the seat (2);

the improvement wherein the heating means are induction means, comprising an inductor (4) rigidly connected to the seat (2) and an armature (6, 18, 19) connected rigidly to the applicator (1), and wherein the distribution means (7, 9) comprise a ring rotatable in the tank, the ring having a diameter between 60 and 95% of the greatest internal dimension of the tank.

8. A hair removal wax application system according to claim 7, wherein said ring comprises said armature.

9. A hair removal wax application system according to claim 7, wherein the outer diameter of the ring is about 85% of the greatest internal dimension of the tank.

10. A hair removal wax application system according to claim 7 and studs rigidly connected to the interior of the tank and maintaining said ring in position inside the tank.

* * * * *